US007798162B2

(12) United States Patent
Sy-Facunda

(10) Patent No.: US 7,798,162 B2
(45) Date of Patent: Sep. 21, 2010

(54) CANOPY WITH REINFORCED EAVES

(75) Inventor: Ron Sy-Facunda, Thousand Oaks, CA (US)

(73) Assignee: Bravo Sports, Santa Fe Springs, CA (US)

( * ) Notice: Subject to any disclaimer, the term of this patent is extended or adjusted under 35 U.S.C. 154(b) by 245 days.

(21) Appl. No.: 11/854,974

(22) Filed: Sep. 13, 2007

(65) Prior Publication Data

US 2009/0071521 A1 Mar. 19, 2009

(51) Int. Cl.
*E04H 15/16* (2006.01)
*E04H 15/50* (2006.01)

(52) U.S. Cl. ..... 135/94; 135/145

(58) Field of Classification Search ..... 135/117, 135/143–145, 94

See application file for complete search history.

(56) References Cited

U.S. PATENT DOCUMENTS

| | | | |
|---|---|---|---|
| 39,416 | A | 8/1863 | Moakley |
| 42,996 | A | 5/1864 | Pullan |
| 42,995 | A | 5/1867 | Pullan |
| 590,706 | A | 9/1897 | Lentz et al. |
| 785,672 | A | 3/1905 | Gleason |
| 1,531,622 | A | 8/1921 | Parsons |
| 2,230,454 | A | 12/1939 | Friesner et al. |
| 3,621,857 | A | 11/1971 | May et al. |
| 4,077,419 | A | 3/1978 | Lux |
| 4,179,053 | A | 12/1979 | Figura |
| 4,200,115 | A | 4/1980 | Parker |
| 4,201,412 | A | 5/1980 | Williams et al. |
| 4,248,255 | A | 2/1981 | Arrowsmith |
| 4,258,778 | A | 3/1981 | Upton et al. |
| 4,285,354 | A | 8/1981 | Beavers |
| 4,469,114 | A | 9/1984 | Kelley et al. |
| 4,530,389 | A | 7/1985 | Quinn et al. |
| 4,583,779 | A | 4/1986 | Myers |
| 4,607,656 | A | 8/1986 | Carter |
| 4,635,667 | A | 1/1987 | Harn |
| 4,641,676 | A | 2/1987 | Lynch |
| 4,720,945 | A | 1/1988 | Berranger et al. |
| 4,753,285 | A | 6/1988 | Lohausen |

(Continued)

FOREIGN PATENT DOCUMENTS

| | | |
|---|---|---|
| AU | 2002247358 | 5/2003 |

(Continued)

OTHER PUBLICATIONS

Related U.S. Appl. No. 11/855,013, filed Sep. 13, 2007 Title Canopy With Ventilation.

(Continued)

*Primary Examiner*—David Dunn
*Assistant Examiner*—Danielle Jackson
(74) *Attorney, Agent, or Firm*—Holland & Hart LLP

(57) ABSTRACT

The technology of the present application provides a collapsible canopy shelter having reinforced eaves for additional structural integrity, as well as at least one collapsible ventilation flap in the canopy cover that is capable of moving between a closed position and an open position to ventilate air from beneath the canopy cover as desired. Further, the collapsible canopy shelter comprises a canopy frame with a robust, spring-loaded pull latch, allowing the user to quickly and easily assemble and collapse the shelter without risking injury.

6 Claims, 10 Drawing Sheets

U.S. PATENT DOCUMENTS

| | | | |
|---|---|---|---|
| 4,759,396 | A | 7/1988 | Quinn |
| 4,779,635 | A | 10/1988 | Lynch |
| 4,784,204 | A | 11/1988 | Lohausen |
| 4,794,971 | A | 1/1989 | Lohausen |
| 4,798,031 | A | 1/1989 | George |
| 4,814,655 | A | 3/1989 | Kaminski |
| 4,825,484 | A | 5/1989 | Riegel |
| 4,865,066 | A | 9/1989 | Brooks |
| 4,885,891 | A | 12/1989 | Lynch |
| 4,898,198 | A | 2/1990 | Castlebury |
| 4,924,896 | A | 5/1990 | Carter |
| 4,926,782 | A | 5/1990 | Lacy |
| 4,930,183 | A | 6/1990 | Owens |
| 4,947,884 | A | 8/1990 | Lynch |
| 4,955,287 | A | 9/1990 | Dupont |
| 4,976,487 | A | 12/1990 | Ramos et al. |
| D316,288 | S | 4/1991 | Lynch |
| 5,035,253 | A | 7/1991 | Bortles |
| 5,090,435 | A | 2/1992 | Leclercq |
| 5,092,262 | A | 3/1992 | Lacy |
| 5,148,849 | A | 9/1992 | Faludy |
| 5,174,352 | A | 12/1992 | Murray et al. |
| 5,187,843 | A | 2/1993 | Lynch |
| 5,224,307 | A | 7/1993 | Lukos |
| 5,226,440 | A | 7/1993 | Fuhrman |
| 5,234,011 | A | 8/1993 | Lynch |
| 5,244,001 | A | 9/1993 | Lynch |
| 5,299,395 | A | 4/1994 | Smith et al. |
| 5,307,856 | A | 5/1994 | Murray |
| 5,335,685 | A | 8/1994 | Dahulich |
| 5,381,814 | A | 1/1995 | Brandon |
| 5,407,007 | A | 4/1995 | Lowrey |
| 5,421,356 | A | 6/1995 | Lynch |
| 5,422,189 | A | 6/1995 | Warner et al. |
| 5,472,007 | A | 12/1995 | Malott |
| 5,485,863 | A | 1/1996 | Carter |
| 5,490,533 | A | 2/1996 | Carter |
| 5,511,572 | A | 4/1996 | Carter |
| 5,591,530 | A | 1/1997 | Warner et al. |
| 5,592,982 | A | 1/1997 | Murray et al. |
| 5,601,104 | A | 2/1997 | Perkins |
| 5,611,364 | A | 3/1997 | Woods et al. |
| 5,632,292 | A | 5/1997 | Carter |
| 5,632,293 | A | 5/1997 | Carter |
| 5,678,361 | A | 10/1997 | Bair |
| 5,700,048 | A | 12/1997 | Wade et al. |
| 5,701,923 | A | 12/1997 | Losi et al. |
| 5,794,640 | A | 8/1998 | Jang |
| 5,797,412 | A | 8/1998 | Carter |
| 5,806,547 | A | 9/1998 | Derlinga |
| 5,813,425 | A | 9/1998 | Carter |
| 5,836,330 | A | 11/1998 | Franklin |
| 5,842,652 | A | 12/1998 | Warsing et al. |
| 5,843,548 | A | 12/1998 | Sanders |
| 5,909,761 | A | 6/1999 | Murray |
| 5,918,614 | A | 7/1999 | Lynch |
| 5,921,260 | A | 7/1999 | Carter |
| 5,934,301 | A | 8/1999 | Carter |
| 5,934,349 | A | 8/1999 | Faller |
| 5,944,040 | A | 8/1999 | Jang |
| 5,975,613 | A | 11/1999 | Sippel |
| 5,995,385 | A | 11/1999 | Shimamura |
| 6,006,810 | A | 12/1999 | Malott |
| 6,021,796 | A | 2/2000 | Vavra |
| 6,021,834 | A | 2/2000 | Malott |
| 6,021,835 | A | 2/2000 | Malott |
| 6,027,137 | A | 2/2000 | Rura |
| 6,029,732 | A | 2/2000 | Malott |
| 6,041,800 | A | 3/2000 | Carter |
| 6,044,593 | A | 4/2000 | Puls |
| 6,070,604 | A | 6/2000 | Carter |
| 6,076,312 | A | 6/2000 | Carter |
| 6,089,973 | A | 7/2000 | Schultz |
| 6,095,221 | A | 8/2000 | Frey, Jr. |
| 6,098,693 | A | 8/2000 | Frey, Jr. |
| 6,112,392 | A | 9/2000 | Becker et al. |
| 6,126,715 | A | 10/2000 | Luk |
| 6,129,102 | A | 10/2000 | Carter |
| 6,138,702 | A | 10/2000 | Carter |
| 6,142,438 | A | 11/2000 | Cooper et al. |
| 6,152,157 | A | 11/2000 | Jang |
| 6,173,725 | B1 | 1/2001 | Garth |
| 6,179,513 | B1 | 1/2001 | Marasco |
| 6,192,910 | B1 | 2/2001 | Carter |
| 6,206,020 | B1 | 3/2001 | Lynch |
| 6,219,888 | B1 | 4/2001 | Lynch |
| 6,227,217 | B1 | 5/2001 | Peta |
| 6,230,729 | B1 | 5/2001 | Carter |
| 6,230,783 | B1 | 5/2001 | Frey, Jr. |
| 6,240,940 | B1 | 6/2001 | Carter |
| 6,260,908 | B1 | 7/2001 | Fraula et al. |
| 6,273,172 | B1 | 8/2001 | Frey |
| 6,276,382 | B1 | 8/2001 | Bindschatel et al. |
| 6,276,424 | B1 | 8/2001 | Frey, Jr. |
| 6,279,641 | B1 | 8/2001 | Malott |
| 6,283,136 | B1 | 9/2001 | Chen |
| 6,283,537 | B1 | 9/2001 | DeVore, III |
| 6,361,011 | B1 | 3/2002 | Brutsaert |
| 6,361,057 | B1 | 3/2002 | Carter |
| 6,363,956 | B2 | 4/2002 | Carter |
| 6,374,842 | B1 | 4/2002 | Carter |
| 6,382,224 | B1 | 5/2002 | Carter |
| 6,394,868 | B1 | 5/2002 | Katz |
| 6,397,872 | B1 | 6/2002 | Carter |
| 6,412,507 | B1 | 7/2002 | Carter |
| 6,418,953 | B1 | 7/2002 | Novotny |
| 6,431,193 | B2 | 8/2002 | Carter |
| 6,439,251 | B2 | 8/2002 | Carter |
| 6,470,902 | B1 | 10/2002 | Carter |
| 6,478,039 | B2 | 11/2002 | Suh |
| 6,488,069 | B1 | 12/2002 | Mashaw et al. |
| 6,502,597 | B2 | 1/2003 | Carter |
| 6,508,262 | B1 | 1/2003 | Takayama |
| 6,520,196 | B2 | 2/2003 | Carter |
| 6,575,656 | B2 | 6/2003 | Suh |
| 6,578,854 | B2 | 6/2003 | Wucherpfennig et al. |
| 6,598,612 | B1 | 7/2003 | Crowe |
| 6,601,599 | B2 | 8/2003 | Carter |
| 6,622,425 | B2 | 9/2003 | Shepherd |
| 6,662,816 | B1 | 12/2003 | Cunningham |
| 6,666,223 | B2 | 12/2003 | Price et al. |
| 6,692,058 | B1 | 2/2004 | Micco |
| 6,701,949 | B2 | 3/2004 | Carter |
| 6,705,664 | B1 | 3/2004 | Lahutsky |
| 6,712,083 | B2 | 3/2004 | Carter |
| 6,718,995 | B2 | 4/2004 | Dotterweich |
| 6,725,807 | B1 | 4/2004 | Tapia |
| 6,748,963 | B2 | 6/2004 | Carter |
| 6,749,474 | B2 | 6/2004 | Hsu et al. |
| 6,761,391 | B2 | 7/2004 | Winkler |
| 6,772,780 | B2 | 8/2004 | Price |
| 6,796,320 | B2 | 9/2004 | Carter |
| 6,845,780 | B2 | 1/2005 | Bishirjian |
| 6,868,858 | B2 | 3/2005 | Suh |
| 6,874,520 | B2 | 4/2005 | Carter |
| 6,920,889 | B2 | 7/2005 | Carter |
| 6,926,021 | B2 | 8/2005 | Carter |
| 6,981,510 | B2 | 1/2006 | Carter |
| 7,007,706 | B2 | 3/2006 | Pinnell et al. |
| 7,025,073 | B2 | 4/2006 | Holub |
| 7,025,075 | B2 | 4/2006 | Suh |
| 7,036,270 | B1 | 5/2006 | Shepherd |
| 7,051,745 | B2 | 5/2006 | Carter |
| 7,055,538 | B2 | 6/2006 | Deng |

| | | | |
|---|---|---|---|
| 7,074,124 | B2 | 7/2006 | Williams |
| 7,097,380 | B2 | 8/2006 | Lee |
| 7,134,443 | B1 | 11/2006 | Shires |
| 7,146,996 | B1 | 12/2006 | Shires |
| 7,178,541 | B2 | 2/2007 | Carter |
| 7,178,542 | B2 | 2/2007 | Carter |
| 7,207,344 | B2 | 4/2007 | Wu |
| 7,210,492 | B2 | 5/2007 | Gerrie et al. |
| 7,234,753 | B2 | 6/2007 | Held et al. |
| 7,240,685 | B2 | 7/2007 | Seo |
| 7,240,686 | B2 | 7/2007 | Seo |
| 7,240,687 | B2 | 7/2007 | Carter |
| 7,252,108 | B2 | 8/2007 | Carter |
| 7,299,812 | B2 | 11/2007 | Carter |
| 7,308,901 | B2 | 12/2007 | Meyer |
| 7,311,112 | B2 | 12/2007 | Pacheco |
| 7,328,935 | B1 | 2/2008 | Tarin |
| 7,354,096 | B2 | 4/2008 | Hacker |
| 7,360,549 | B2 | 4/2008 | Seo |
| 7,380,563 | B2 | 6/2008 | Seo |
| 7,395,830 | B2 | 7/2008 | Seo |
| 7,406,977 | B1 | 8/2008 | Shires |
| 7,409,963 | B2 | 8/2008 | Mallookis et al. |
| 7,428,908 | B2 | 9/2008 | Seo |
| RE40,544 | E | 10/2008 | Suh |
| RE40,657 | E | 3/2009 | Suh |
| 7,568,491 | B2 | 8/2009 | Banfill et al. |
| 2002/0092555 | A1 | 7/2002 | Chen et al. |
| 2006/0062632 | A1 | 3/2006 | Jang |
| 2006/0096631 | A1 | 5/2006 | Mallookis et al. |
| 2006/0130887 | A1 | 6/2006 | Mallookis et al. |
| 2006/0169311 | A1 | 8/2006 | Hwang |
| 2006/0260666 | A1 | 11/2006 | Choi |
| 2007/0079855 | A1 | 4/2007 | Li |
| 2007/0186967 | A1 | 8/2007 | Zingerle |

FOREIGN PATENT DOCUMENTS

| | | | |
|---|---|---|---|
| AU | 2004203308 | | 2/2005 |
| CA | 2447952 | | 11/2002 |
| CA | 2475232 | A1 | 2/2005 |
| CA | 2455021 | | 4/2007 |
| CA | 2441567 | | 6/2007 |
| EP | 534643 | | 3/1993 |
| GB | 2398346 | | 4/2005 |
| GB | 2392459 | | 11/2005 |
| GB | 2404932 | | 11/2005 |
| GB | 2406107 | | 11/2005 |
| GB | 2410041 | | 11/2005 |
| GB | 2410962 | | 10/2008 |
| GB | 2472418 | | 4/2009 |
| WO | WO 89/07696 | | 8/1989 |
| WO | WO 02/68779 | | 9/2002 |
| WO | WO 2004/059106 | | 7/2004 |

OTHER PUBLICATIONS

Related U.S. Appl. No. 11/854,911, filed Sep. 13, 2007 Title Canopy Latch System.

Non-Final Office Action dated Dec. 18, 2008 received in Related U.S. Appl. No. 11/855,013.

Non-Final Office Action dated Nov. 20, 2008 received in Related U.S. Appl. No. 11/854,911.

Final Rejection dated Jun. 3, 2009 received in Related U.S. Appl. No. 11/854,911.

Office Action Received in U.S. Appl. No. 12/201,789 mailed Sep. 21, 2009.

Related U.S. Appl. No. 12/201,789, filed Aug. 29, 2006 Title Canopy With One or More Side Awnings.

CANOPY WITH REINFORCED EAVES

BACKGROUND

1. Field

The present invention relates generally to collapsible canopy shelters and more specifically to collapsible canopy shelters with reinforced eaves, an adjustable ventilation system, and spring loaded pull latches.

2. Background

Many tents and canopy shelters with collapsible frames exist. These structures are commonly used to provide portable shelter for outdoor activities such as camping, picnicking, parties, weddings, and more. Such collapsible canopy shelters typically comprise a canopy cover and a canopy frame configured to stand alone when in an assembled position and to collapse into a compact position for storage and transport.

While conventional collapsible canopy shelters are useful for a variety of purposes, such as providing portable shade and/or shelter from the elements and providing an aesthetically pleasing backdrop for special events, conventional canopy frames lack structural integrity. As a result, they are vulnerable to severe weather and human or animal interference and are prone to bow or sag.

In addition, the support poles of conventional canopy frames typically have unreliable latches that stick when the user attempts to assemble or collapse the shelter. Moreover, traditional spring-pin latches, or latches comprising a retractable spring pin that the user pushes inward to release, are temperamental to use and can pinch the user's hands and fingers when he or she attempts to assemble or collapse the shelter.

Moreover, conventional canopy covers do not allow for adjustable ventilation. They either have no ventilation at all and trap unwanted heat during warm weather, or alternately, they have permanent screens or vents that vent much needed warm air during cool weather. There is therefore a need in the art for a collapsible canopy shelter having a frame with greater structural rigidity and stability and robust, easy to use pull latches, as well as an adjustable ventilation system.

SUMMARY

Embodiments disclosed herein address the above stated needs by providing a collapsible canopy shelter with reinforced eaves to provide greater structural integrity. The technology of the present application also features a collapsible flap capable of moving between a closed and an open position to ventilate air from the collapsible canopy shelter when desired. Another aspect of the technology of the present application includes a sliding, spring-loaded pull latch to lock the eaves in an assembled position.

The foregoing, as well as other features, utilities, and advantages of the invention will be apparent from the following more particular description of a preferred embodiment of the invention as illustrated in the accompanying drawings.

DETAILED DESCRIPTION

Figure 1:
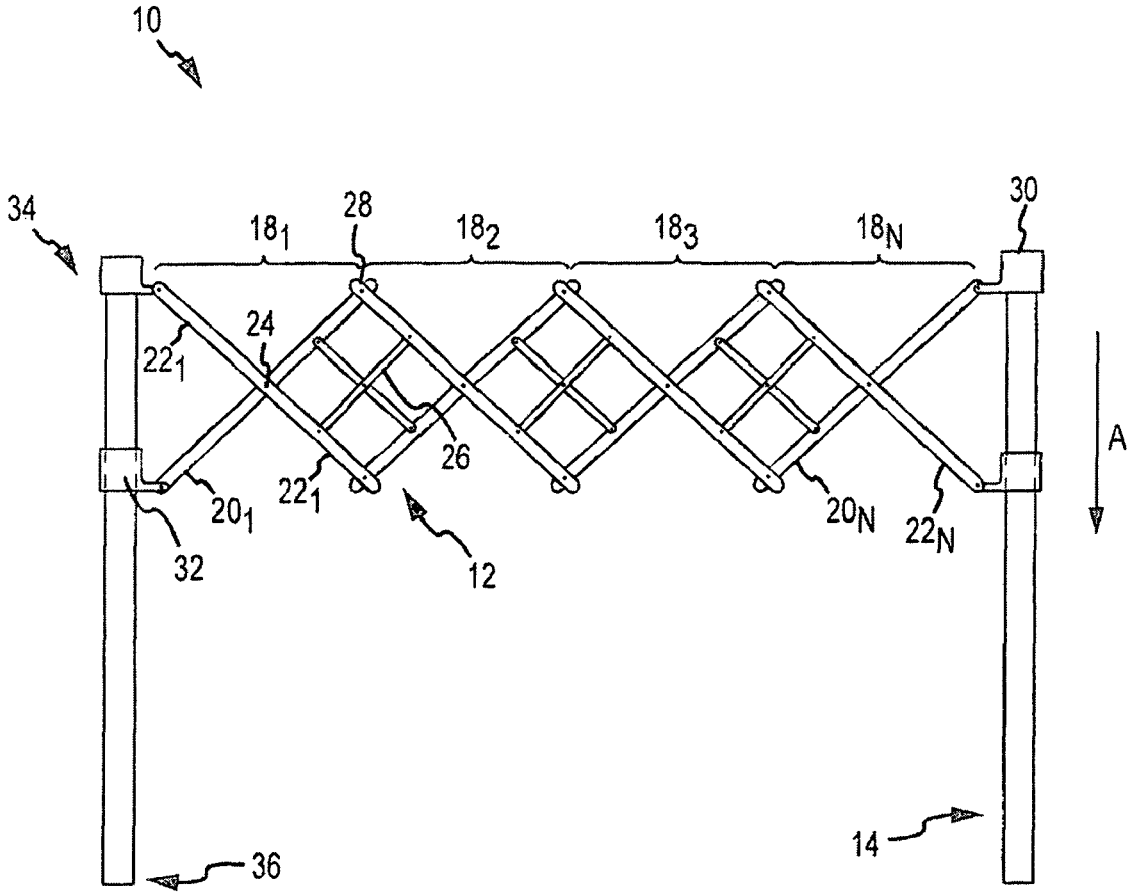
FIG. 1 shows a front plan view of one embodiment of a canopy frame for a collapsible canopy shelter.

The technology of the present application will be further explained with reference to FIGS. 1 through 10. FIG. 1 shows a front plan view of one embodiment of a canopy frame 10 for a collapsible canopy shelter. In this embodiment, canopy frame 10 comprises a plurality of eaves 12 linking a plurality of upwardly extending poles 14. Each eave 12 may comprise a series of pivotally coupled scissor-jacks $\mathbf{18}_{1\text{-}n}$. Each scissor-jack $\mathbf{18}_{1\text{-}n}$ may include a left cross member $\mathbf{20}_{1\text{-}n}$ and a right cross member $\mathbf{22}_{1\text{-}n}$, crossed and pivotally coupled at a cross point 24. To provide additional rigidity to improve the structural integrity of canopy frame 10, two reinforcing cross members 26 may be crossed and pivotally coupled to left cross members $\mathbf{20}_{1\text{-}n}$ and right cross members $\mathbf{22}_{1\text{-}n}$ at each intersection 28 of scissor-jacks $\mathbf{18}_{1\text{-}n}$. All pivoting joints may be pinned, bolted, riveted, joined by rotational fasteners, or otherwise relatively connected as is known in the art.

Each eave 12 may be collapsibly coupled to a pair of upwardly extending poles 14 through two fixed eave mounts 30 and two sliding eave mounts 32. Fixed eave mounts 30 may be fixably coupled to the top ends 34 of upwardly extending poles 14, and sliding eave mounts 32 may be slidably coupled to poles 14, such that sliding eave mounts 32 slide over the length of upwardly extending poles 14 from the bases 36 of poles 14 to just below fixed eave mounts 30. In turn, a first left cross member $\mathbf{20}_1$ and a final right cross member $\mathbf{22}_N$ may be pivotally coupled to sliding eave mounts 32 while a first right cross member $\mathbf{22}_1$ and a final left cross member $\mathbf{20}_N$ may be fixably coupled to fixed eave mounts 30, allowing scissor-jacks $\mathbf{18}_{1\text{-}N}$ to collapse in a manner similar to the compression of an accordion when one or more of sliding eave mounts 32 are released and slid in a downward direction denoted by arrow A.

Of course, one of ordinary skill in the art will readily understand that several alternative mechanisms could be used to collapsibly couple eaves 12 to upwardly extending poles 14. For example, eaves 12 could be coupled to upwardly extending poles 14 through locking channel systems or a quick release for scissor-jacks $\mathbf{18}_{1\text{-}N}$, as is generally known in the art.

Figure 2:
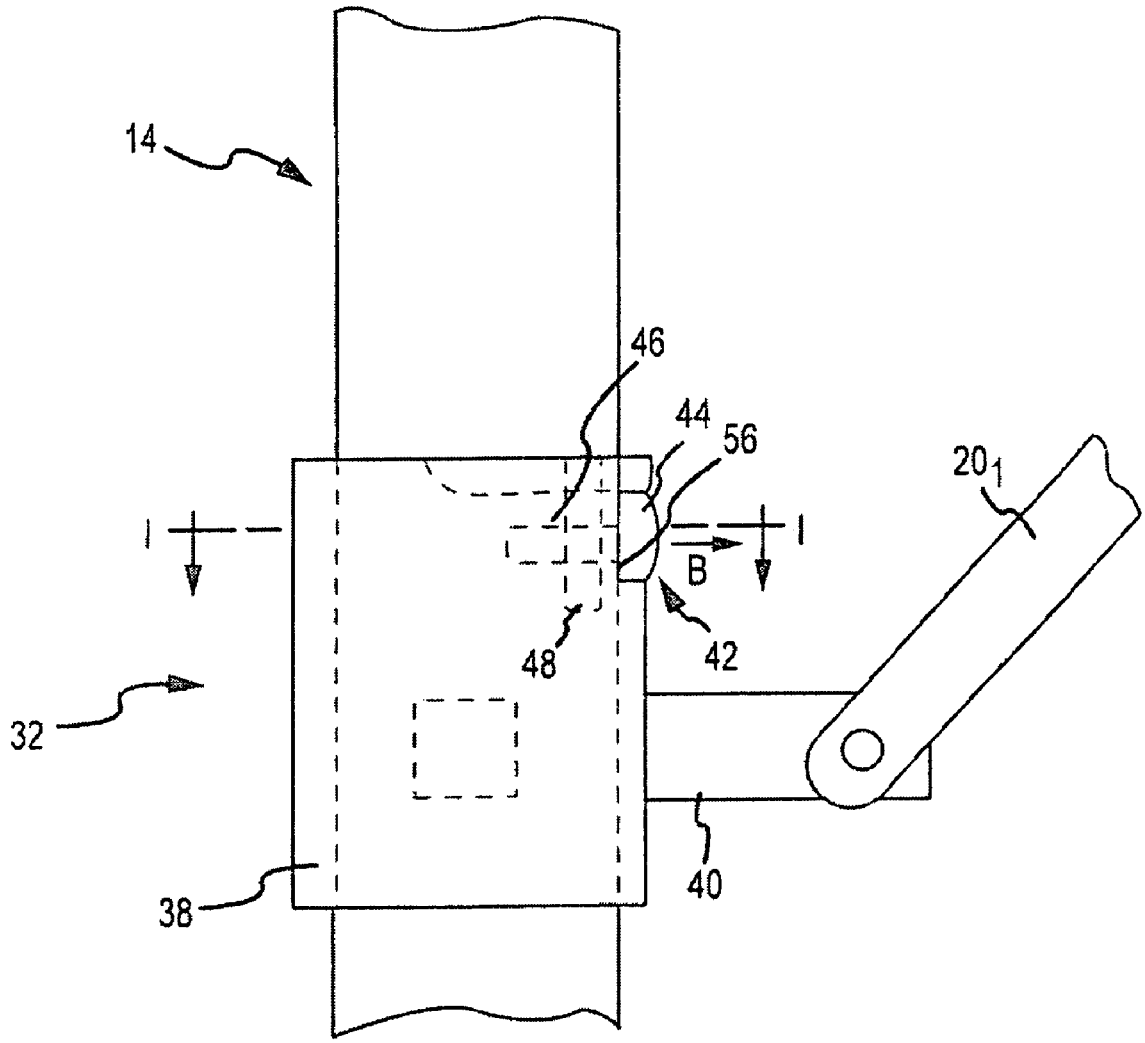
FIG. 2 shows a side plan view of one embodiment of a sliding eave mount slidably coupled to an upwardly extending pole and fixably coupled to the first left cross member.

FIG. 2 shows a side plan view of sliding eave mount 32 slidably coupled to upwardly extending pole 14 and fixably coupled to first left cross member $\mathbf{20}_1$. In this embodiment, sliding eave mount 32 may comprise a sliding body 38, a plurality of arms 40 to fixably attach to eaves 12, and a latch 42. In further detail, latch 42 may comprise a spring-loaded lever 44 with a locking pin 46 that is pivotally coupled to sliding body 38 through a hinge pin 48 that may be press fit into sliding body 38. A torsion spring 50 (FIGS. 3, 4) may encircle hinge pin 48, such that a first leg 52 and a second leg 54 of torsion spring 50 compress when lever 44 is pulled in the direction of arrow B. Lever 44 and locking pin 46 may be configured to allow locking pin 46 to mate with a pin hole 56 located in upwardly extending pole 14 when latch 42 and locking pin 46 are slid into alignment with pin hole 56.

Figure 3:
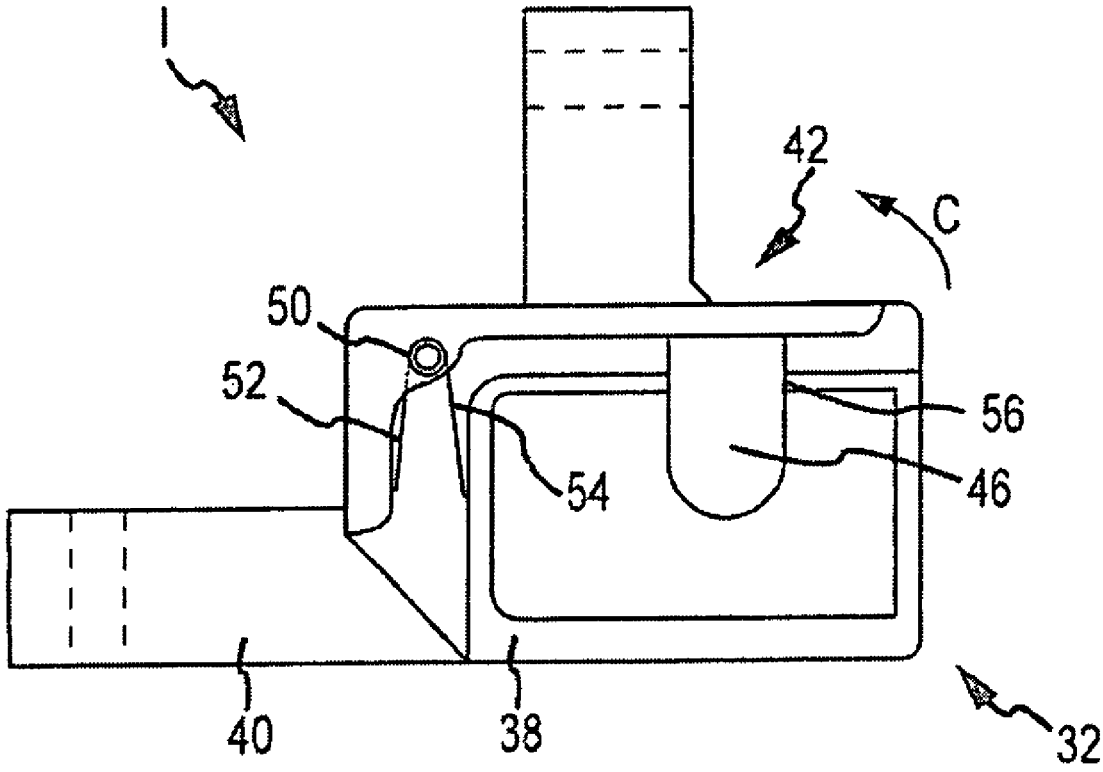
FIG. 3 shows a sectional view of one embodiment of the sliding eave mount shown in FIG. 2 with the latch in the locked position.
Figure 4:
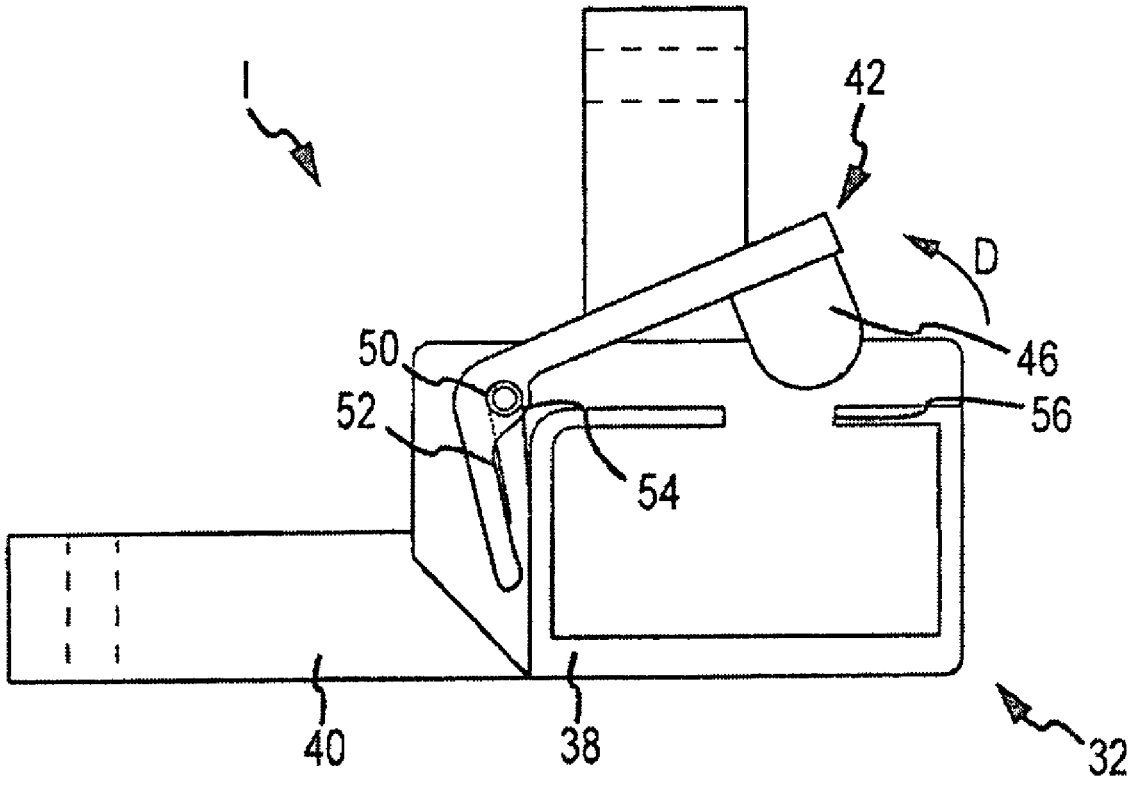
FIG. 4 shows a sectional view of the embodiment of the sliding eave mount shown in FIG. 2 with the latch in the unlocked position.

FIGS. 3 and 4 show sectional views of one embodiment of sliding eave mount 32 with latch 42 in the locked and unlocked positions, respectively. To unlock latch 42, a user may swivel latch 42 in the direction of arrow C, thereby withdrawing locking pin 46 from pin hole 56 and compressing torsion spring 50. As a result, sliding eave mount 32 may slide in a downward direction along upwardly extending pole 14 (FIG. 1) and allow eave 12 to collapse as upwardly extending pole 14 is moved inward towards the remaining upwardly extending poles 14.

To lock latch 42, a user may slide sliding eave mount 32 upward into alignment with pin hole 56. Once in alignment, torsion spring 50 automatically pivots latch 42 in the direction of arrow D (FIG. 4), thereby snapping locking pin 46 into pin hole 56 and locking sliding eave mount 32 into an assembled position. While described as a torsion spring here, other elastically deformable devices are possible, including, for example, helical or coil springs, leaf springs, or the like. These deformable devices may be formed of spring metals such as music wire or metal alloys, plastics, composites, or any other suitable material known in the art.

Figure 5:
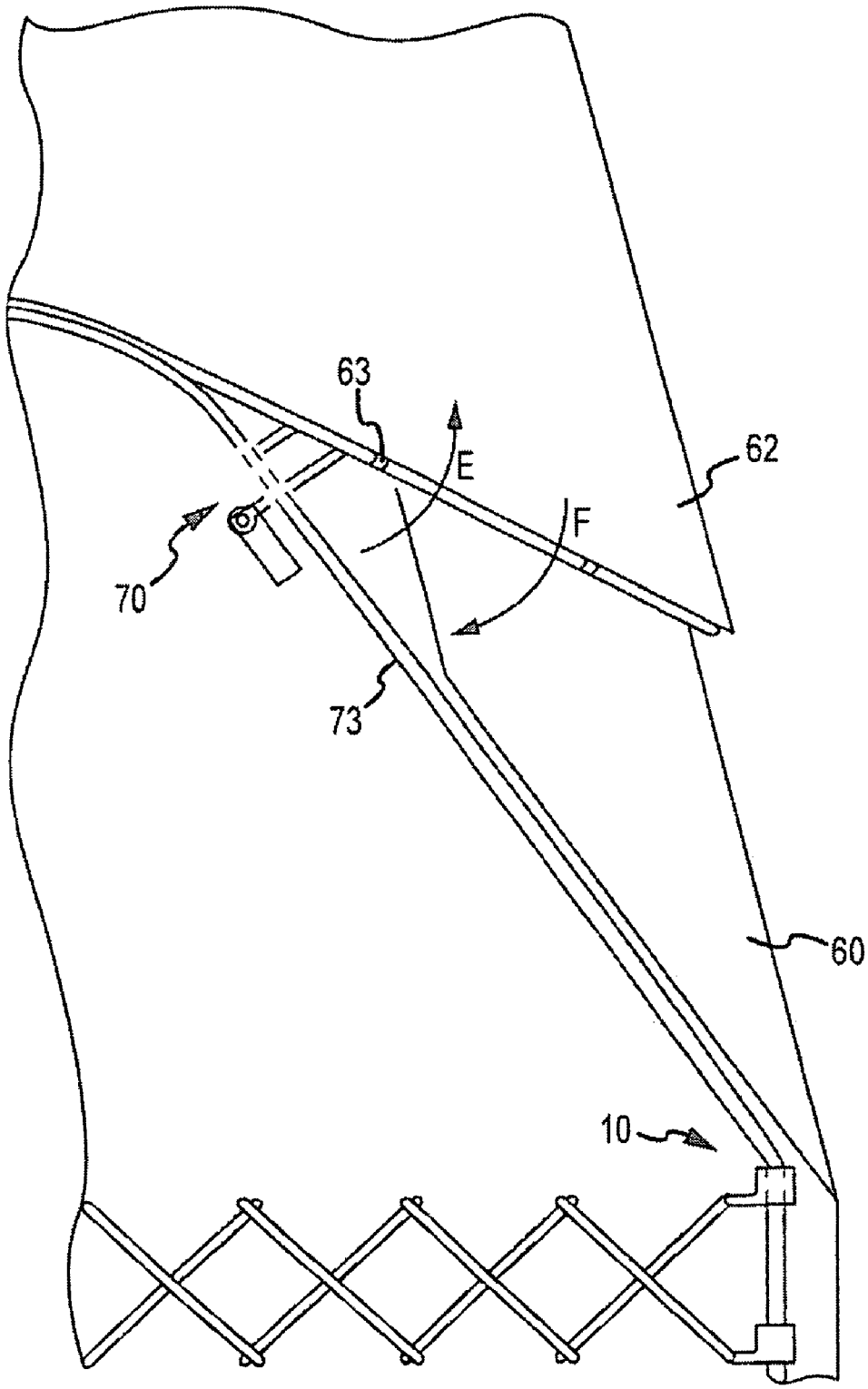
FIG. 5 shows a partial side plan view of one embodiment of the canopy frame and the canopy cover having at least one collapsible flap supported by a pivoting support.
Figure 9:
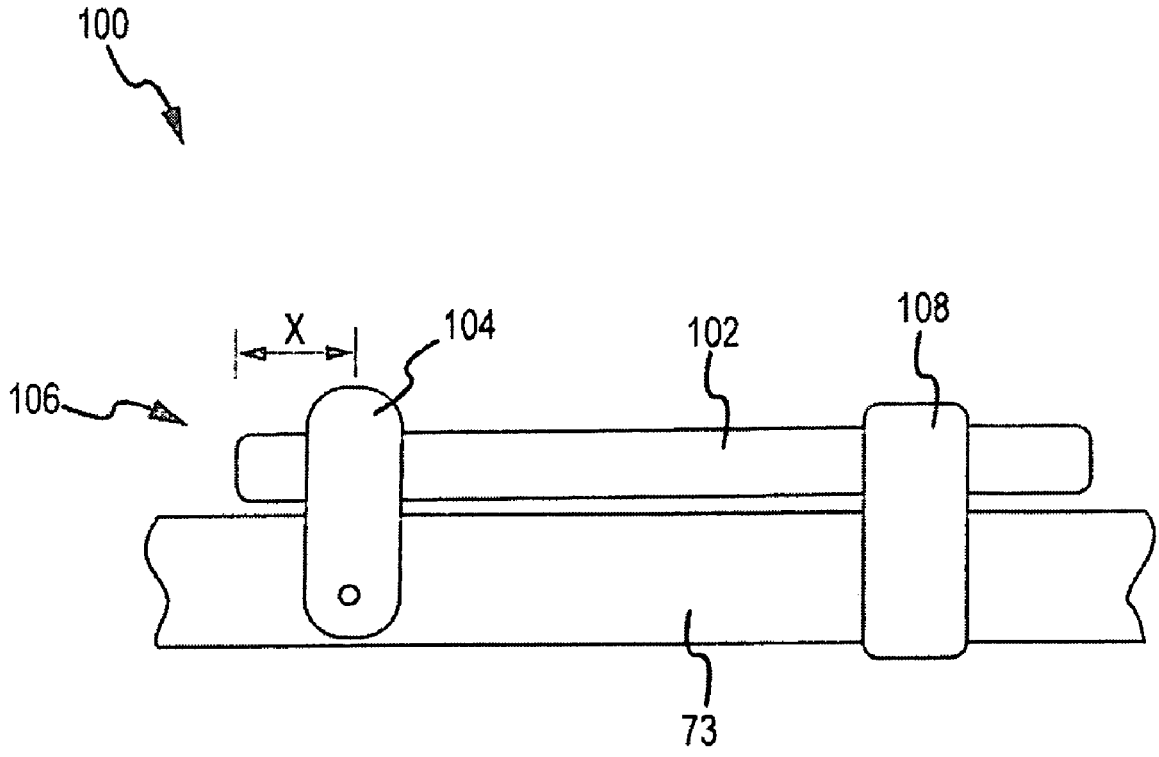
FIG. 9 shows a side plan view of the embodiment of the pivoting support shown in FIG. 8 in the closed position.
Figure 10:
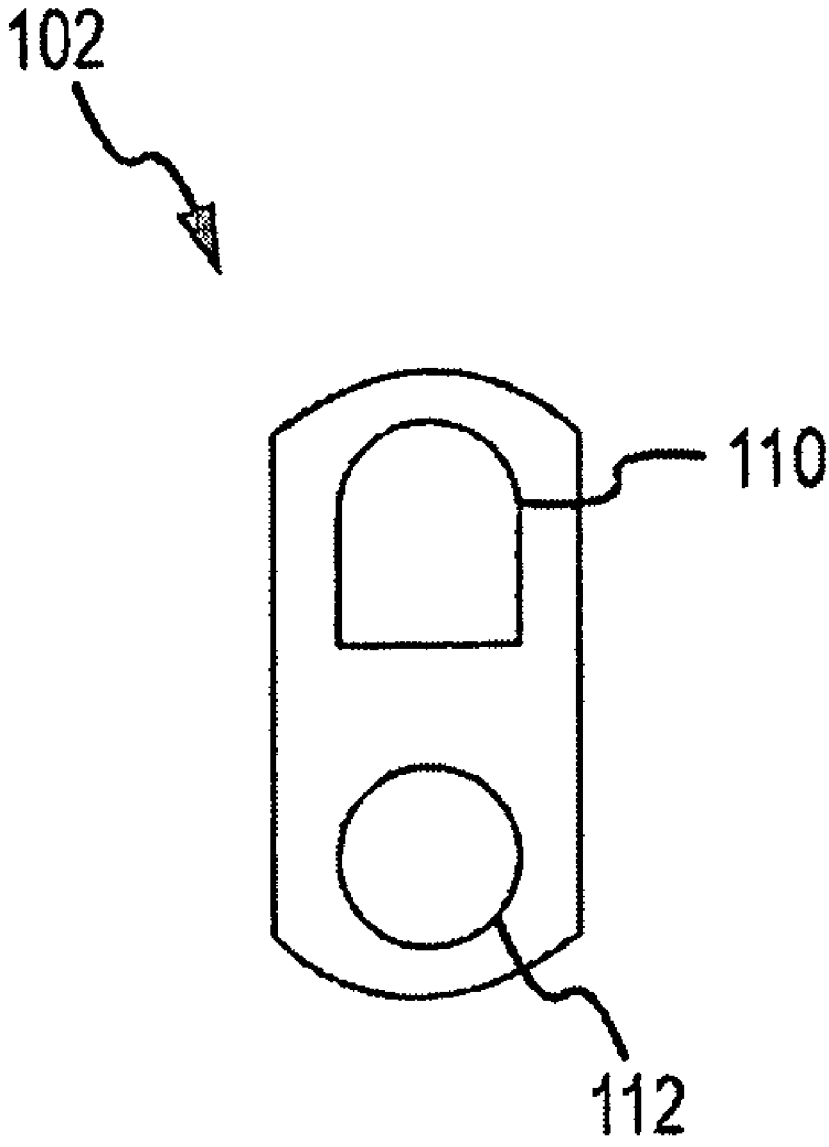
FIG. 10 shows a front plan view of one embodiment of a fulcrum.

To ventilate air from the collapsible canopy shelter, one embodiment of the collapsible canopy shelter may include at least one collapsible flap that may be opened and closed as desired. FIG. 5 shows a partial side plan view of one embodiment of canopy frame 10 having a cover support member 73, as well as a canopy cover 60 having at least one collapsible flap 62 supported by a pivoting support 70, 100 (FIGS. 9, 10). To ventilate air from beneath canopy cover 60, pivoting support 70, 100 may be used to pivot collapsible flap 62 in the direction of arrow E into an open position. Alternately, collapsible flap 62 may be pivoted in the direction of arrow F into a closed position to prevent air flow. One of ordinary skill in the art will readily understand that a user may also position collapsible flap 62 in any intermediate position between the open and closed positions.

Figure 6:
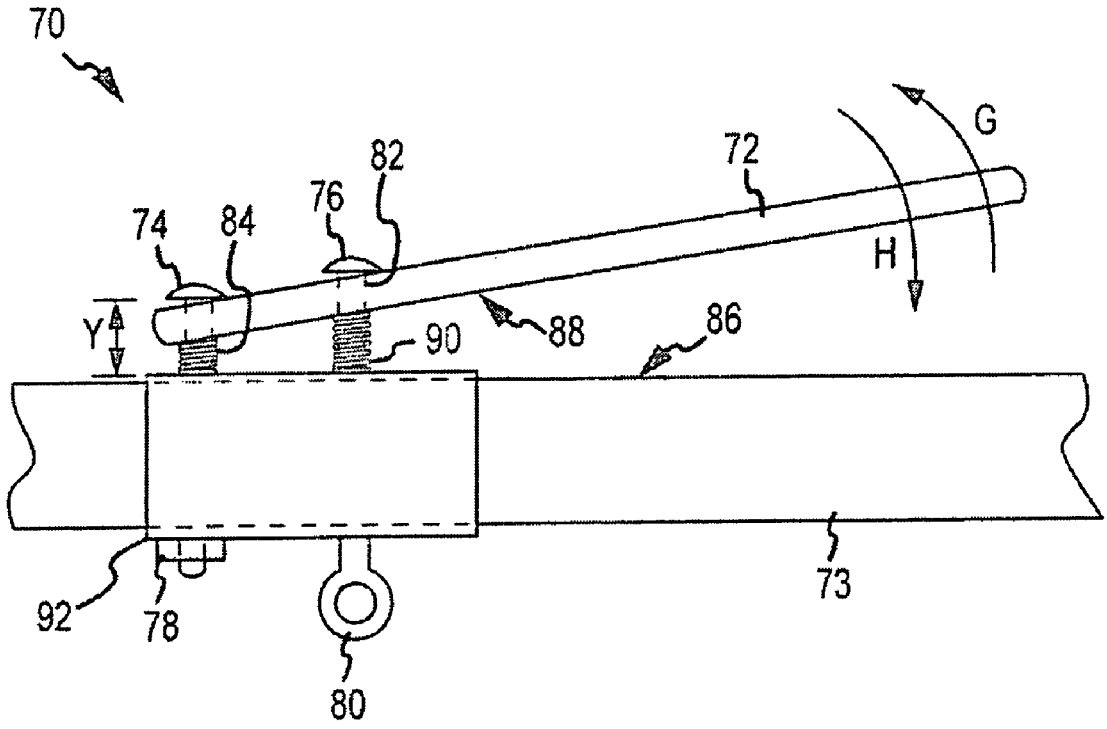
FIG. 6 shows a side plan view of one embodiment of the pivoting support in the open position.
Figure 7:
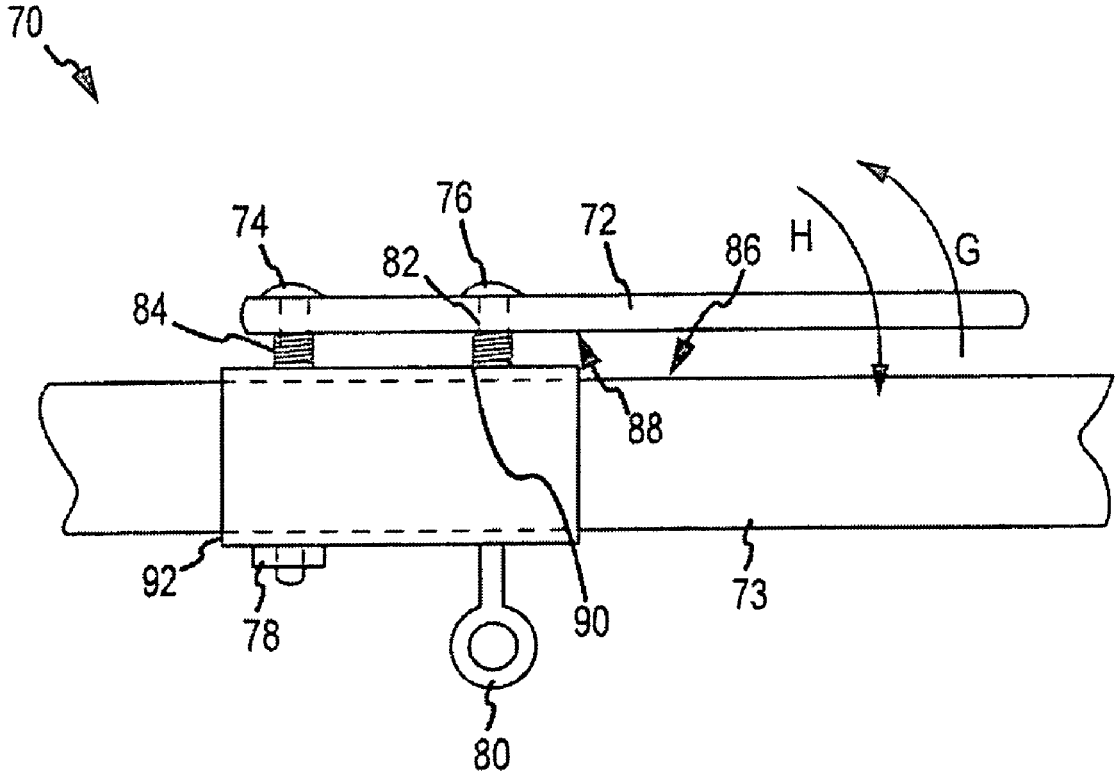
FIG. 7 shows a side plan view of the pivoting support shown in FIG. 6 in the closed position.

In further detail, FIGS. 6 and 7 show side plan views of one embodiment of pivoting support 70 in the open and a closed positions, respectively. In this embodiment, pivoting support 70 may comprise a cantilever 72 attached to collapsible flap 62 through a set of cover straps 63 or any other means of attachment generally known in the art, including, for example, a sheath formed of canopy material, snaps, VELCRO®, and the like. Cantilever 72 may also be pivotally coupled to cover support member 73 through a fixed fastener 74 and an adjustable fastener 76, each of which may intersect cover support member 73 and cantilever 72 along an axis that is perpendicular to cantilever 72. Fixed fastener 74 may be set at a fixed height y and held in position by a nut 78. Adjustable fastener 76 may comprise a handle 80 and be threaded into a threaded receiving hole 82 in cantilever 72, such that rotating handle 80 in a first direction pivots cantilever between the closed position and the open position in the direction of arrow G, and rotating adjustable fastener in a second, opposite direction pivots the cantilever between the open position and the closed position in the direction of arrow H.

A first flexible spacer 84 may encase fixed fastener 74 between a top surface 86 of cover support member 73 and a bottom surface 88 of cantilever 72, while a second flexible spacer 90 may encase adjustable fastener 76 between a top surface 86 of cover support member 73 and a bottom surface 88 of cantilever 72. First and second flexible spacers 84, 90 stabilize cantilever 72 and allow it to pivot between the closed and open positions in response to the rotation of adjustable fastener 76. Flexible spacers may be formed of rubber or any other suitable elastic material with a density sufficient to withstand the downward force exerted by the weight of cantilever 72 and collapsible flap 62.

Fixed fastener 74 and adjustable fastener 76 may consist of a variety of rotational fasteners, including, for example, screws, bolts, adjustable pins, or any other suitable fastener as is generally known in the art. Optionally, pivoting support 70 may further comprise a sleeve 92. Sleeve 92 may provide aesthetic benefits as well as protect cover support member 73 from exposure to light and moisture at the points where it has been drilled to accommodate fixed fastener 74 and adjustable fastener 76.

Figure 8:
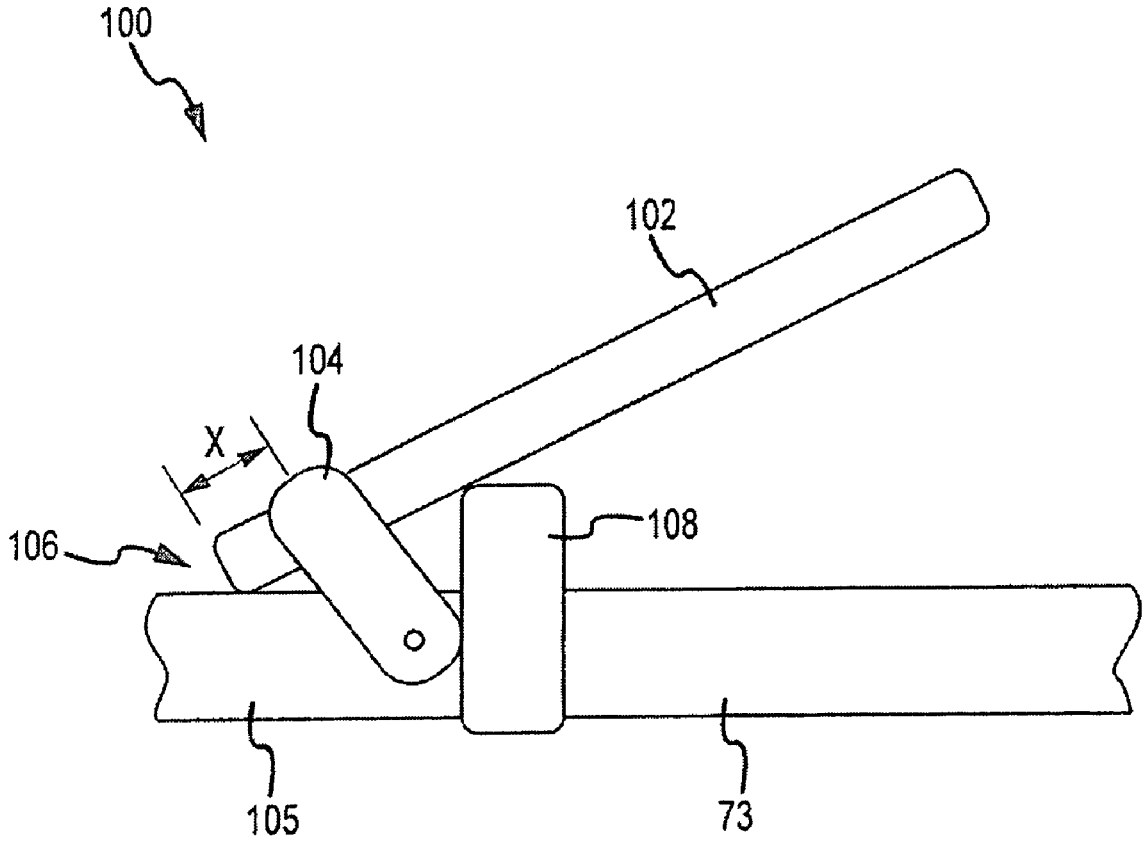
FIG. 8 shows a side plan view of another embodiment of a pivoting support in the open position.

FIGS. 8 and 9 illustrate side plan views of another embodiment of pivoting support 100 in the open and closed positions, respectively. Pivoting support 100 may comprise a cantilever 102 that is attached to cover support member 73 in the same manner discussed with respect to cantilever 72 above. Moreover, cantilever 102 may be pivotally coupled with cover support member 73 through a pivoting bracket 104 located at a pivot point 105. Pivoting bracket 104 may be offset a distance x from a pivot end 106 of cantilever 102, such that pivot end 106 serves as a hard stop to prevent cantilever 102 from rotating beyond the open position shown in FIG. 8. In addition, a fulcrum 108 may be slidably coupled to cover support member 73 such that it restrains cantilever 102 when in the closed position and props cantilever 102 when in the open position or any position between the closed and open positions.

FIG. 10 shows a front plan view of one embodiment of fulcrum 108. In this embodiment, fulcrum 108 may comprise a cantilever hole 110 sized to frictionally engage cantilever 102 when cantilever 102 is in the closed position shown in FIG. 9. Fulcrum 108 may further comprise a roof support hole 112 configured to slidably engage with roof support member 73, such that it props cantilever 102 when in the open position shown in FIG. 8. Of course, one of ordinary skill in the art will readily understand that fulcrum 108 may prop cantilever 102 in any intermediate position between the closed and open positions to provide varying levels of air flow. Cantilever 102, bracket 104, and fulcrum 108 may be formed of metal, plastic, or any other material of suitable strength as is generally known in the art.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A collapsible canopy shelter, comprising:

a canopy cover comprising at least one collapsible flap adapted to move between an open position and a closed position, the collapsible flap ventilating air from the shelter when in the open position; and a canopy frame to support the canopy cover, the canopy frame comprising:

a plurality of upwardly extending poles with an eave linking each pair of the plurality of upwardly extending poles, each eave comprising:

a plurality of pivotally coupled scissor-jacks, each scissor-jack having a left cross member and a right cross member crossed and pivotally coupled at a cross point, wherein a first left cross member is slidably coupled to a first pole, a first right cross member is fixably coupled to the first pole, a final left cross member is fixably coupled to a second pole, and a final right cross member is slidably coupled to the second pole; and two reinforcing cross members crossed and pivotally coupled to the left and right cross members; and at least one cantilever to open and close the at least one collapsible flap, the cantilever including a free end and a pivot point, the pivot point being pivotally coupled to the canopy frame such that the cantilever pivots between a closed position and an open position, and a fulcrum that is slidably coupled to the canopy frame such that it restrains the free end of the cantilever when in the closed position and props the cantilever near the pivot point when in the open position.

2. The collapsible canopy shelter of claim 1, wherein the fulcrum props the cantilever at an intermediate point when in an intermediate position.

3. The collapsible canopy shelter of claim 1, wherein the fulcrum is slidably coupled to a cover support member of the canopy frame.

4. The collapsible canopy shelter of claim 1, wherein the fulcrum comprises a roof support hole and a cantilever hole, wherein the roof support hole is sized to slidably engage with the canopy frame and the cantilever hole is sized to frictionally engage with the free end of the cantilever.

5. The collapsible canopy shelter of claim 1, further comprising a hard stop to prevent the cantilever from pivoting beyond the open position.

6. The collapsible canopy shelter of claim 5, wherein the hard stop comprises a second end of the cantilever, wherein when the cantilever is in the open position, the second end abuts the canopy frame, thereby preventing further rotation of the cantilever.

* * * * *